US005787718A

United States Patent [19]

Jeong

[11] Patent Number: 5,787,718

[45] Date of Patent: Aug. 4, 1998

[54] METHOD FOR CONTROLLING QUICK COOLING FUNCTION OF REFRIGERATOR

[75] Inventor: Seo Kook Jeong, Seoul, Rep. of Korea

[73] Assignee: Samsung Electronics Co., Ltd., Suwon, Rep. of Korea

[21] Appl. No.: 784,552

[22] Filed: Jan. 21, 1997

[30] Foreign Application Priority Data

Jan. 23, 1996 [KR] Rep. of Korea ..... 96-1401

[51] Int. Cl.[6] ..... F25D 17/06

[52] U.S. Cl. ..... 62/157; 62/161; 62/179; 62/231

[58] Field of Search ..... 62/200, 199, 157, 62/158, 231, 161, 162, 163, 164, 229, 180, 186, 179

[56] References Cited

U.S. PATENT DOCUMENTS

| | | | |
|---|---|---|---|
| 3,001,378 | 9/1961 | Stutrud | 62/157 |
| 4,389,854 | 6/1983 | Ogita et al. | 62/163 X |
| 4,439,998 | 4/1984 | Horvay et al. | 62/200 X |
| 5,033,272 | 7/1991 | Yoshikawa et al. | 62/199 |
| 5,375,428 | 12/1994 | LeClear et al. | 62/187 |

*Primary Examiner*—Harry B. Tanner
*Attorney, Agent, or Firm*—Larson & Taylor

[57] ABSTRACT

Disclosed is a method for controlling a quick cooling function of a refrigerator. When both compartments are at an abnormal temperature state in a refrigerator the method independently controls a freezer compartment and a refrigerating compartment. The user selects a quick cooling function for any compartment. This method preferentially controls only selected compartment temperature, reducing the time needed to quickly cool the selected compartment, and thus reducing power-consumption. This method of a refrigerator according to the present invention in a refrigerator independently controlling a freezer compartment and a refrigerating compartment, includes: a first step in which a quick cooling function of either the freezer compartment or the refrigerating compartment is selected; a second step in which whether a freezer compartment temperature and a refrigerating compartment temperature are higher than each reference temperature which is predetermined on the basis of an abnormal high temperature state in each compartment is determined; and a third step in which a selected compartment for the quick cooling function is preferentially cooled until a predetermined condition is satisfied, when the freezer compartment temperature and the refrigerating compartment temperature are higher than each reference temperature.

6 Claims, 5 Drawing Sheets

METHOD FOR CONTROLLING QUICK COOLING FUNCTION OF REFRIGERATOR

BACKGROUND OF THE INVENTION

1. Field of the Invention

The present invention relates to a method for controlling a quick cooling function of a refrigerator. More particularly, it relates to a method for more effectively controlling a quick cooling function of a refrigerator, which quickly cools either the freezer compartment or the refrigerating compartment, when both compartments are at an abnormal temperature state in a refrigerator having an evaporator and a cold air cycle fan in each compartment.

2. Description of the Prior Art

A recent development has been a refrigerator having an evaporator and a cold air cycle fan in each of its two compartments, the freezer compartment and the refrigerating compartment, which independently control their respective temperatures.

FIG. 3A is a flow chart of a conventional quick freezing control method of a refrigerator which includes:

- a first step S1 in which it is determined whether the use time is less than a predetermined time X. The use time is the time after a quick freezing function has been requested;
- a second step S2, proceeded to if the predetermined time X has not elapsed in the step S1, in which the current freezer compartment temperature $T_F$ is compared with a quick freezing set temperature $T_{F.P}$;
- a third step S3, proceeded to when the current freezer compartment temperature $T_F$ is higher than the quick freezing set temperature $T_{F.P}$ in the second step S2, in which a current refrigerating compartment temperature $T_R$ is compared with a user-defined refrigerating compartment set temperature $T_{R.S}$;
- a fourth step S4, proceeded to when the current refrigerating compartment temperature $T_R$ is higher than the user-defined refrigerating compartment set temperature $T_{R.S}$ in the third step S3, in which a compressor, a freezer compartment fan and a refrigerating compartment fan are turned on;
- a fifth step S5, proceeded to when the current refrigerating compartment temperature $T_R$ is lower than the user refrigerating compartment set temperature $T_{R.S}$ in the third step S3, in which the compressor and the freezing compartment fan are turned on and the refrigerating compartment fan is turned off; and
- a sixth step S6, proceeded to when the predetermined time X elapses in the first step Si or when the current freezer compartment temperature $T_F$ is lower than the quick freezing set temperature $T_{F.P}$ in the second step S6, in which the quick freezing function is unconditionally released.

In brief, the conventional quick freezing control method of a refrigerator unconditionally releases the quick freezing function when the predetermined time X has elapsed after the quick freezing function has been requested. Even if the predetermined time X has not elapsed, the quick freezing function is released if the freezer compartment temperature $T_F$ is lower than the quick freezing set temperature $T_{F.P}$.

The compressor and the freezer compartment fan are both turned on when the freezer compartment temperature $T_F$ is higher than the quick freezing set temperature $T_{F.P}$, but the turning on of the refrigerating compartment fan is contingent upon the refrigerating compartment temperature $T_R$ being greater then the user-defined refrigerating compartment set temperature $T_{R.S}$.

FIG. 3B is a flow chart of a conventional quick refrigerating control method of a refrigerator which includes:

- a first step S11 in which it is determined whether the use time is less than predetermined time X;
- a second step S22, proceeded to when the predetermined time X has not elapsed in the first step S11, in which a current refrigerating compartment temperature $T_R$ is compared with a quick refrigerating set temperature $T_{R.P}$;
- a third step S33, proceeded to when the current refrigerating compartment temperature $T_R$ is higher than the quick refrigerating set temperature $T_{R.P}$ in the second step S22, in which the current freezer compartment temperature $T_F$ is compared with the user-defined freezer compartment set temperature $T_{F.S}$;
- a fourth step S44, proceeded to when the current freezer compartment temperature $T_F$ is higher than the user-defined freezer compartment set temperature $^{T}$F.S in the third step S33, in which the compressor, the freezer compartment fan and the refrigerating compartment fan are turned on;
- a fifth step S55, proceeded to when the current freezer compartment temperature $T_F$ is lower than the user-defined freezer compartment set temperature $T_{F.S}$ in which the compressor and the refrigerating compartment fan are turned on and the freezer compartment fan is turned off; and
- a sixth step S66, proceeded to when the predetermined time X has elapsed in the first step Sll or when the current refrigerating compartment temperature $T_R$ is lower than the quick refrigerating set temperature $T_{R.P}$ in the second step S22, in which the quick refrigerating function is unconditionally released.

The aforementioned quick freezing and refrigerating control methods, when each compartment is operated within its proper temperature range (i.e., when each compartment is at a steady state), efficiently and quickly cools either a freezer compartment or a refrigerating compartment.

However, when the inside temperature of the refrigerator is over a temperature range suitable for the execution of a freezing/refrigerating function, such as when the refrigerator is plugged back in after being unpowered during transport, time is needed before an adequate temperature is attained. Until this duration of time has passed, the request for a quick cooling function for either compartment is ignored.

More specifically, until the set amount of time has passed after the resumption of power, even if a quick cooling function is requested for only either the refrigerating compartment or the freezer compartment, the respective freezer and refrigerating compartment fans will still operate simultaneously because the refrigerating compartment and the freezer compartment are over the predetermined temperatures.

Accordingly, until both compartments have cooled, the quick freezing or refrigerating methods not only cool the temperature of the selected compartment, but also the temperature of the other compartment which is not selected. Because of this a user cooling command cannot be performed immediately. As a result, the time needed to quickly cool the selected compartment becomes longer, thereby causing unnecessary power consumption.

SUMMARY OF THE INVENTION

Accordingly, the present invention is directed to a method for controlling the quick cooling function of a refrigerator that substantially obviates the above problem due to the limitations and disadvantages of the prior art.

The object of the present invention is to provide a method for controlling the quick cooling function of a refrigerator with independent freezer and refrigeration compartment control. Only the selected compartment's temperature is controlled even if both compartments are at an abnormal temperature state, thereby reducing the time needed to quickly cool the selected compartment and thus reducing power consumption.

In order to achieve this object and others, a quick cooling control method for a refrigerator with independently controlled freezer and refrigerating compartment temperatures according to the present invention includes:

- a first step in which a quick cooling function for either the freezer compartment or the refrigerating compartment is selected;
- a second step in which it is determined if both the freezer compartment and refrigerating compartment temperatures are higher than their respective reference temperatures; and
- a third step, proceeded to when the conditions detailed in the second step arise, in which only the selected compartment for the quick cooling function is preferentially cooled until a predetermined condition is satisfied.

BRIEF DESCRIPTION OF THE DRAWINGS

The preferred embodiment of the present invention will now be described more specifically with reference to the attached drawings, wherein.

DETAILED DESCRIPTION OF THE PREFERRED EMBODIMENT

The preferred embodiment of the present invention will become apparent from a study of the following detailed description in conjunction with an analysis of the accompanying drawings.

Figure 2:
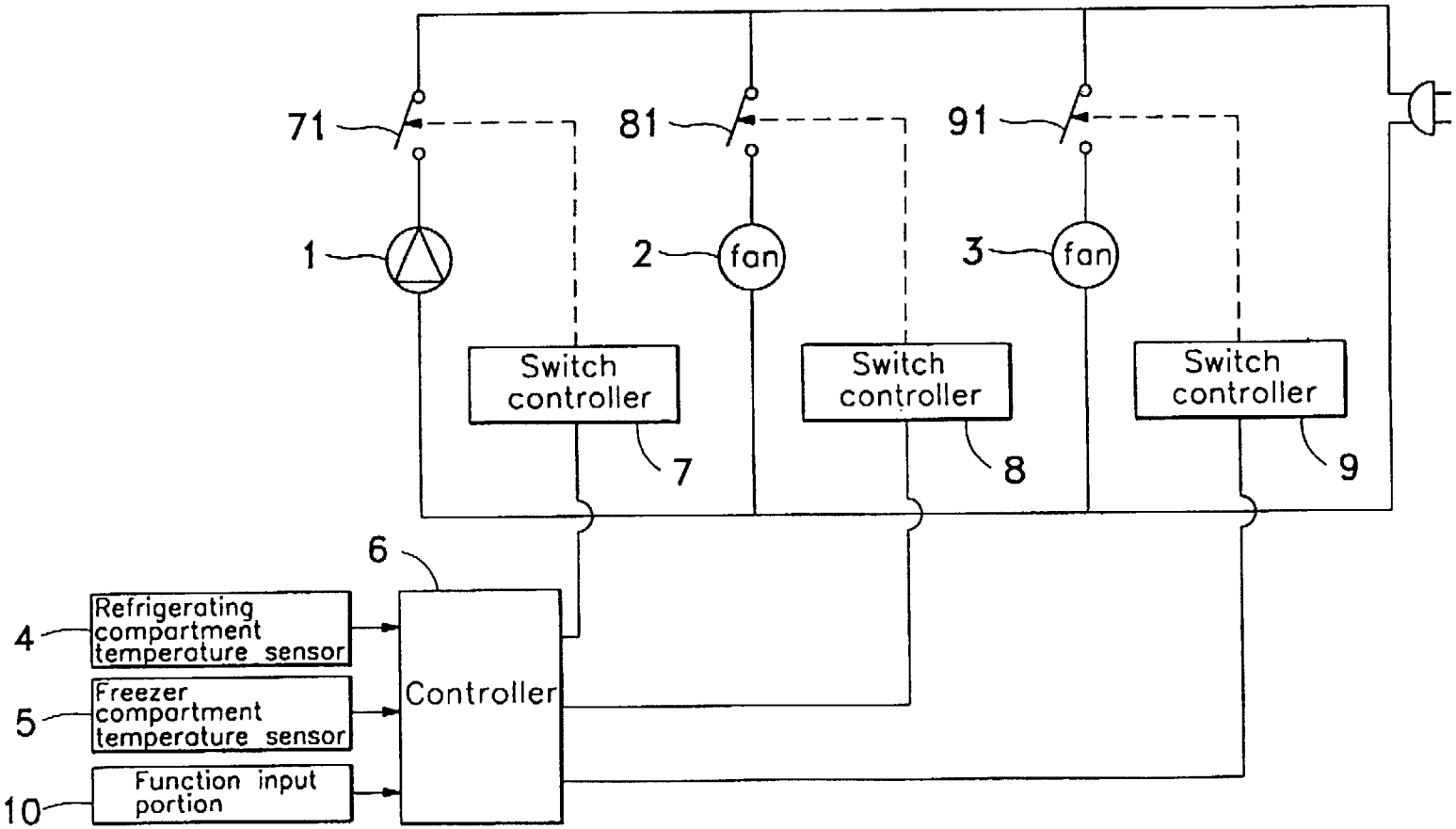
FIG. 2 is a block diagram of an operation control system of a refrigerator in accordance with the preferred embodiment for the present invention.
Figure 3A:
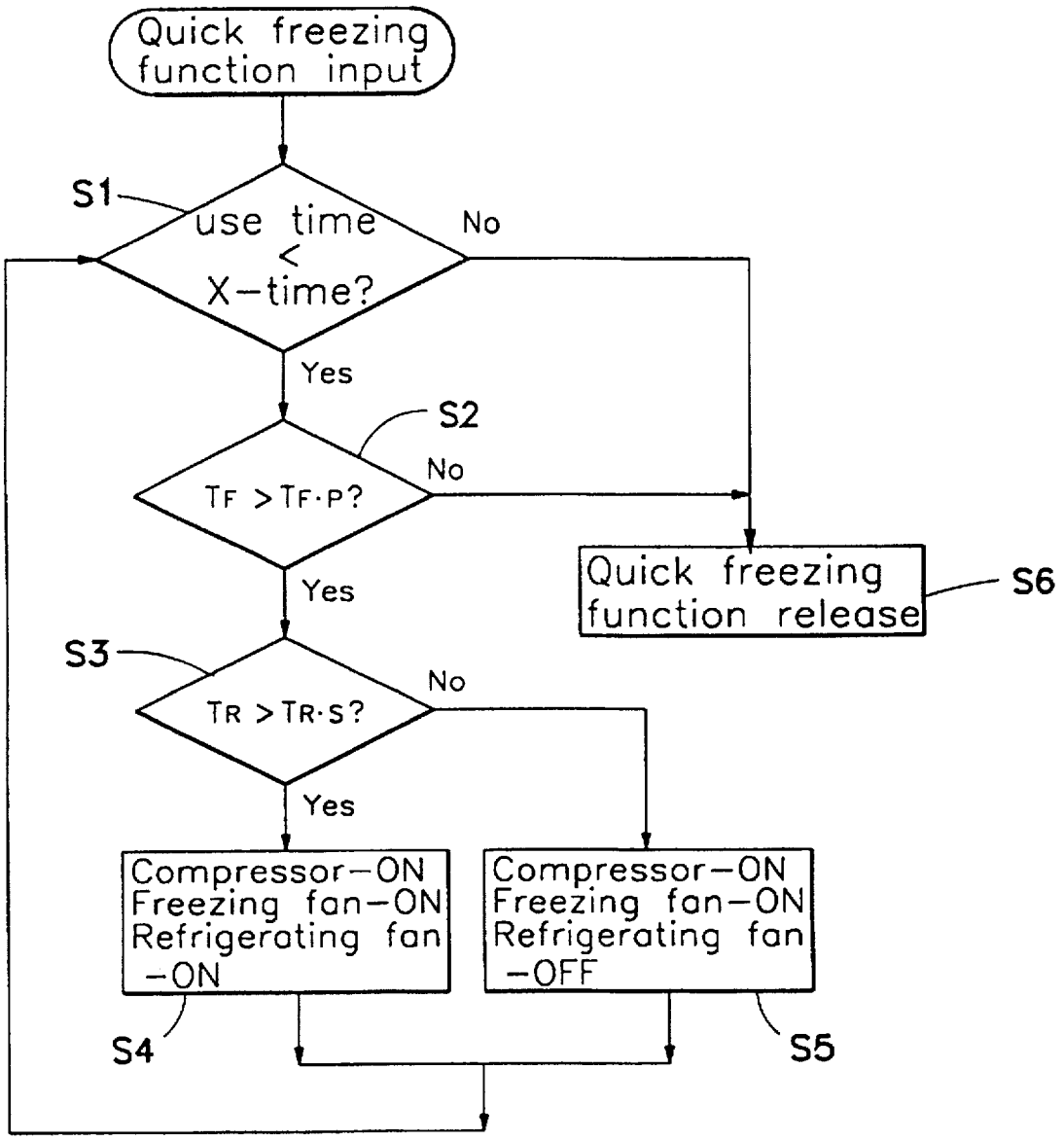
FIG.3A (Prior Art)
FIG. 3A is a flow chart of a conventional quick freezing control method for a refrigerator.
Figure 3B:
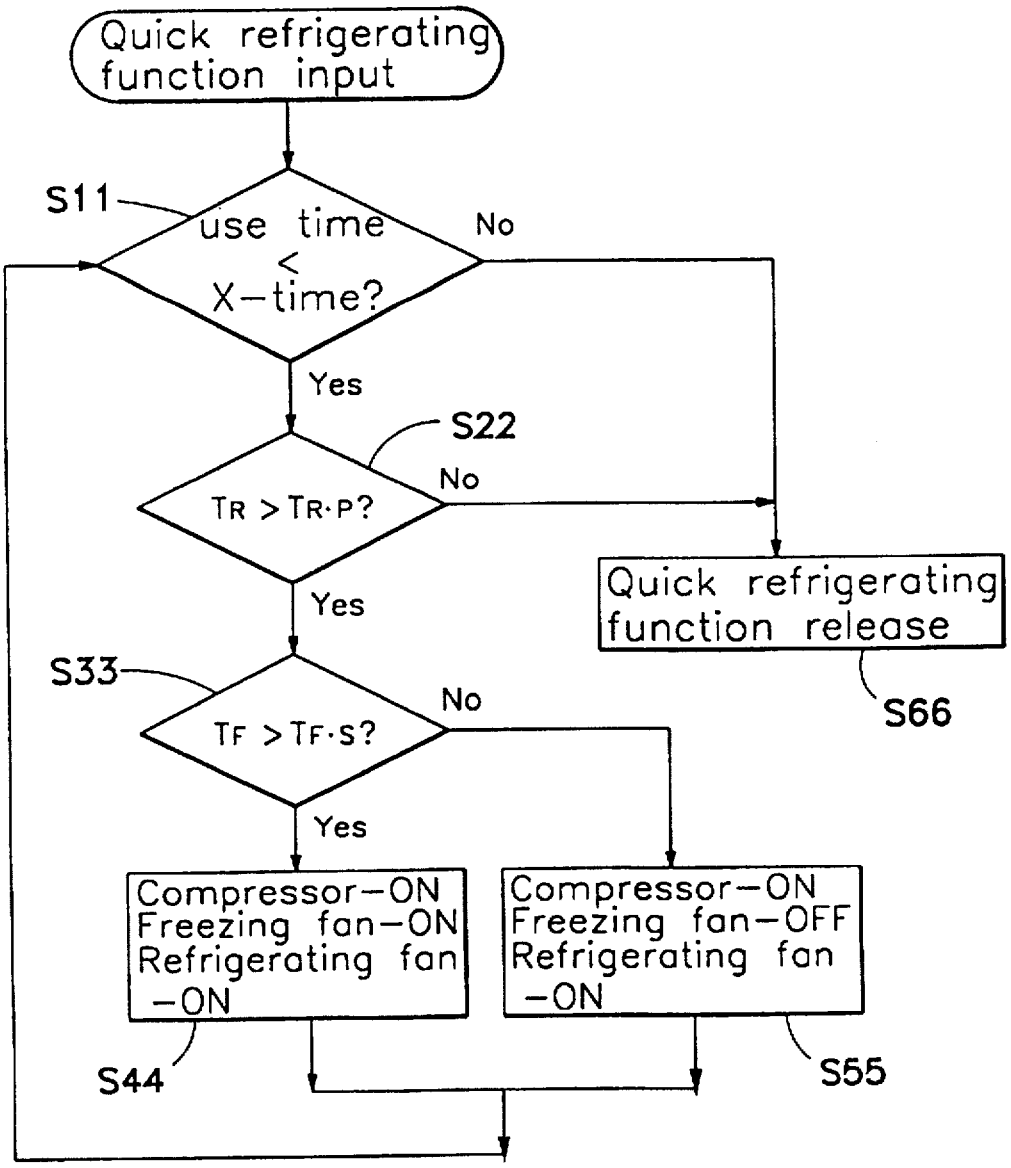
FIG.3B (Prior Art)
FIG. 3B is a flow chart of a conventional quick refrigerating control method for a refrigerator.

As shown in FIG. 2, the operation control system of a refrigerator includes:

- a controller 6 for controlling all operations of the refrigerator;
- a compressor 1 which is included in one part of a cooling cycle;
- a freezer compartment temperature sensor 5 which senses the temperature of the freezer compartment;
- a refrigerating compartment temperature sensor 4 which senses the temperature of the refrigerating compartment;
- a freezer compartment fan 2 which exchanges heat between cold air generated by the evaporator of the freezer compartment and heat of the freezer compartment;
- a refrigerating compartment fan 3 which exchanges heat between cold air generated by the evaporator of the refrigerating compartment and heat of the refrigerating compartment;
- switches 71, 81 and 91 which are in parallel to each other and respectively control the electric flow to the compressor 1, the freezer compartment fan 2 and the refrigerating compartment fan 3;
- switch controllers 7, 8 and 9 which respectively turn the switches 71, 81 and 91 on or off according to operation of the controller 6; and
- a function input portion 10 which receives quick freezing/refrigerating functions and all operations of the refrigerator.

Figure 1A:
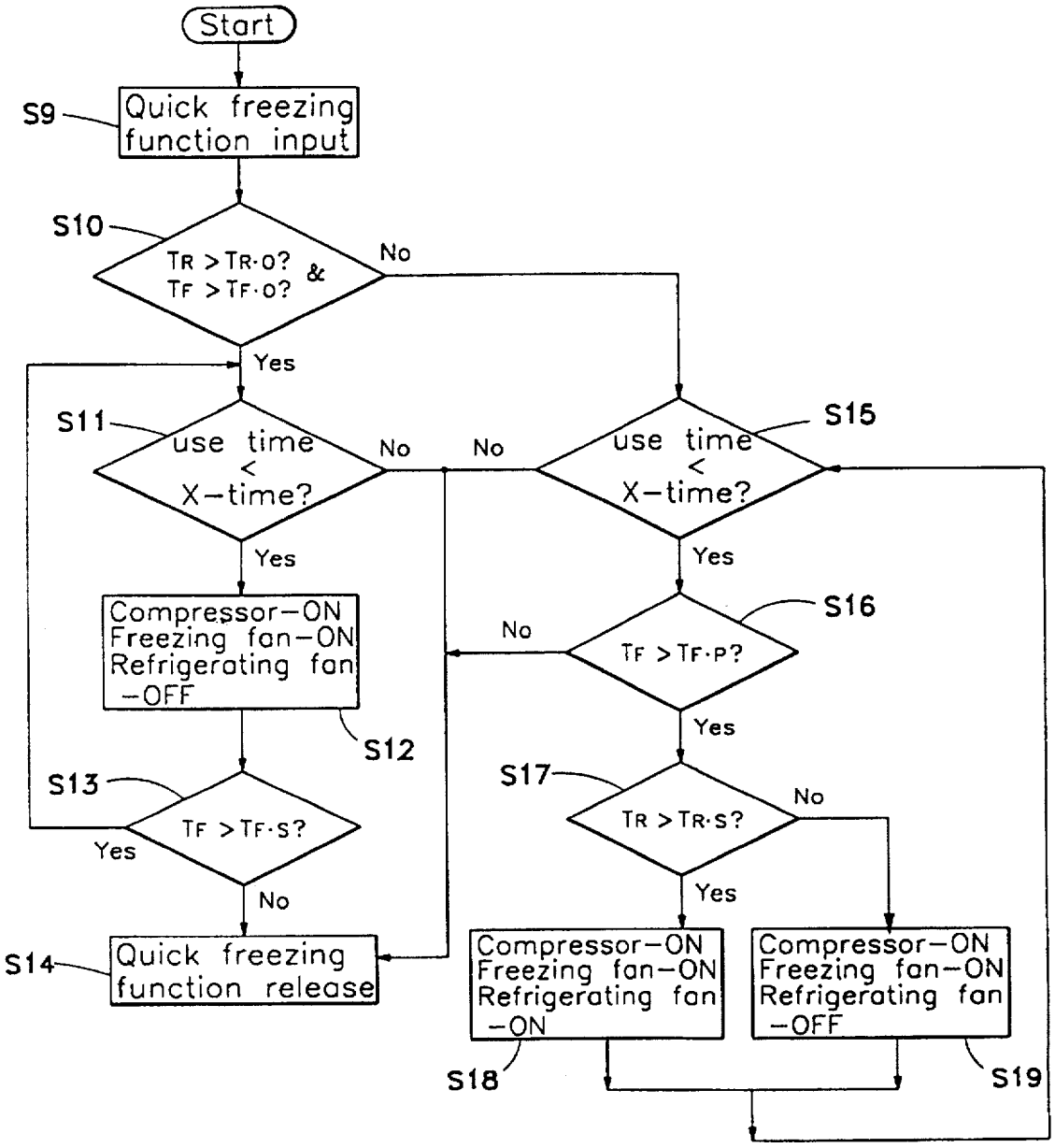
FIG. 1A is a flow chart of a quick freezing control method of a refrigerator in accordance with the preferred embodiment of the present invention.

FIG. 1A is a flow chart of a quick freezing control method for a refrigerator in accordance with the preferred embodiment of the present invention. In step S10, after the user selects the quick freezing function in the first step S9, whether both the freezer compartment's and the refrigerating compartment's temperatures $T_F$ and $T_R$, as detected by each compartment's temperature sensors 4 and 5 are higher than their respective reference temperatures $T_{F.O}$ and $T_{R.O}$ is determined. Some examples of when this condition arises are when the refrigerator is initially set up, when the refrigerator is turned on after being allowed to warm, or when hot or warm food is first introduced to either of its compartments. That is, these cases are very particular cases. At this time, the purpose of selecting a quick freezing function selected by the user is to quickly freeze the food. Herein the freezer compartment reference temperature $T_{F.O}$ is in the range of −10° C.±5° C., although it is favorably set at −10° C. The refrigerating compartment reference temperature $T_{R.O}$ is in the range of 10° C.±5° C., although it is favorably set at 10° C.

If both compartment's temperatures $T_F$ and $T_R$ are higher than their respective reference temperatures $T_{F.O}$ and $T_{R.O}$ in the second step S10, whether a predetermined time X has elapsed from the time when the quick freezing function was requested, is determined (third step S11).

If the use time is less than the predetermined time X in the third step S11, both the compressor 1 and the freezer compartment fan 2 are turned on and the refrigerating compartment fan 3 is turned off (fourth step S12).

Next, the current freezer compartment temperature $T_F$ is compared with the user-defined freezer compartment set temperature $T_{F.S}$ (fifth step S13). Herein, the user-defined freezer compartment set temperature $T_{F.S}$ is set at either 'strong mode', 'intermediate mode' or 'weak mode' all of which being within a predetermined temperature range between −21° C. and −15° C. Accordingly, the user-defined freezer compartment set temperature $T_{F.S}$ is lower than the reference temperature $T_{F.O}$.

If the current freezer compartment temperature $T_F$ is higher than the user-defined freezer compartment set temperature $T_{F.S}$, only the freezer compartment is cooled by repeatedly looping through steps S11 through S13 until either the predetermined time X has elapsed (step S11) or the current freezer compartment temperature $T_F$ is lower than the user-defined freezer compartment set temperature $T_{F.S}$ (step S13). Either of these events terminate the loop and releases the quick freezing function (sixth step S14).

Returning focus to step 10, if either the freezer compartment temperature $T_F$ or the refrigerating compartment temperature $T_R$ is below their respective reference temperatures $T_{F.O}$ and $T_{R.O}$, whether the predetermined time X has elapsed from the time when the quick freezing function was inputted, is determined (seventh step S15).

If the use time is less than the predetermined time X, whether the current freezing compartment temperature $T_F$ is higher than the quick freezing set temperature $T_{F.P}$ is determined (eighth step S16). Herein, the quick freezing set temperature $T_{F.p}$ ranges from −25° C. to −20° C., which is lower than the user-defined freezer compartment set temperature $T_{F.S}$.

If the current freezer compartment temperature $T_F$ is higher than the quick freezing set temperature $T_{F.P}$ in the eighth step S16, the current refrigerating compartment temperature $T_R$ is compared with the user-defined refrigerating compartment set temperature $T_{R.S}$ (ninth step S17). Herein, the user-defined refrigerating compartment set temperature $T_{R.S}$ can be set at either 'strong mode', 'intermediate mode' or 'weak mode' in a predetermined temperature range between 0° C. and 6° C.

If the current refrigerating compartment temperature $T_R$ is higher than the user refrigerating compartment temperature $T_{R.S}$ in the ninth step S17, the compressor 1, the freezer compartment fan 2 and the refrigerating compartment fan 3 are each turned on (tenth step S18).

Alternatively, if the current refrigerating compartment temperature $T_R$ is lower than the refrigerating compartment set temperature $T_{R.S}$, only the compressor 1 and the freezing compartment fan 2 are turned on and the refrigerating compartment fan 3 is turned off (the eleventh step S19).

While looping through the steps S15–S19, either the current freezer compartment temperature $T_F$ being lower than the quick freezing set temperature $T_{F.P}$ (step S16), or the predetermined time X having elapsed (step S15) will bring about the quick freezing function is released (sixth step S14). During this loop, the refrigerator compartment's fan 3 is independently turned on or off by another routine based on the relationship between its temperature $T_F$ and the user-defined refrigerating compartment set temperature $T_{R.S}$.

The introduction of hot food to the freezer compartment or the door to the freezer being left open for extended periods of time may cause the freezer compartment temperature $T_F$ to be higher than the reference temperature $T_{F.O}$ in the second step S10.

In this case, the result of the user selecting a quick freezing function is the maintenance of the refrigerating compartment temperature and the rapid lowering of the freezing compartment temperature $T_F$ which was raised to a higher temperature by the food.

Figure 1B:
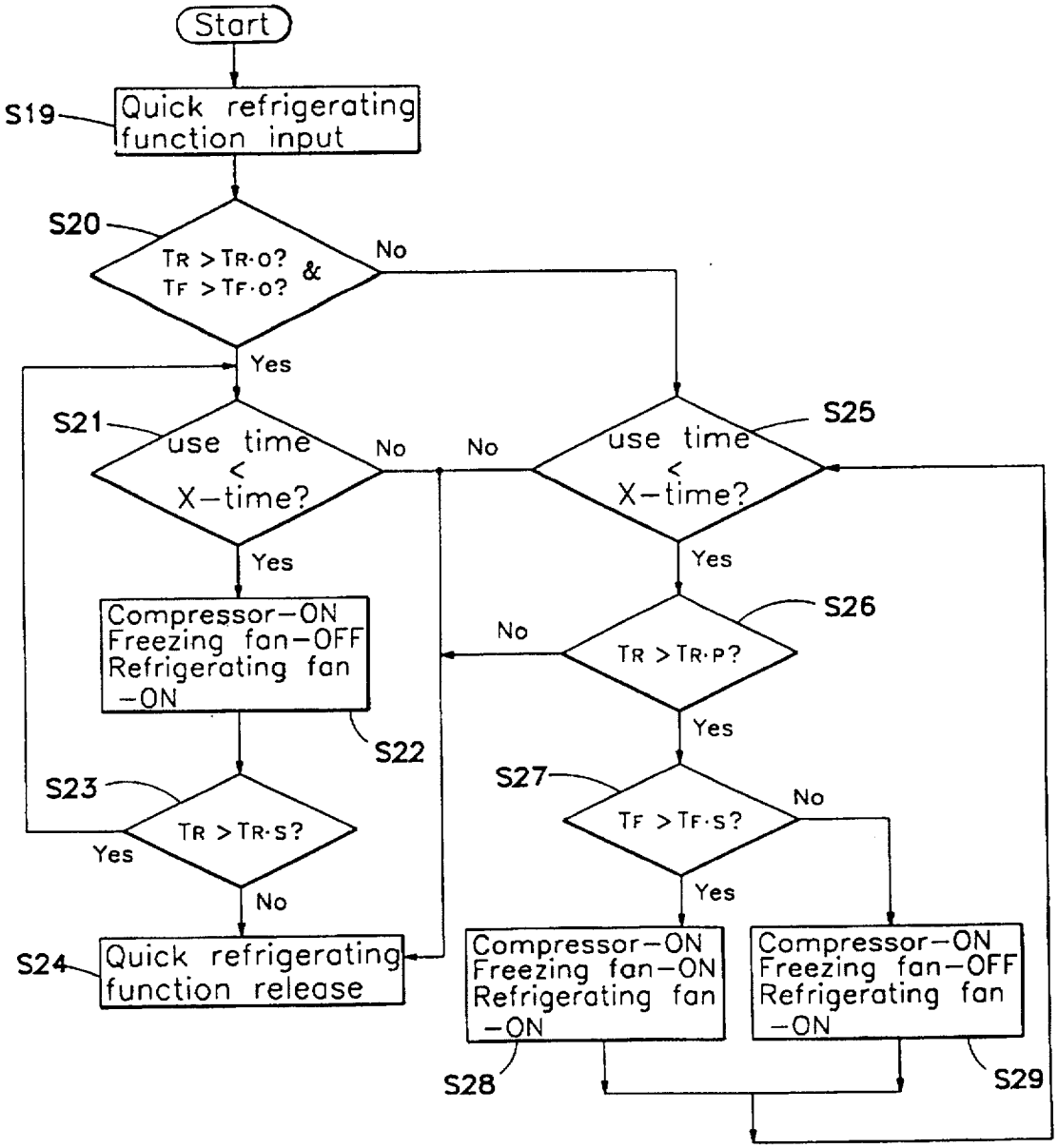
FIG. 1B is a flow chart of a quick refrigerating control method of a refrigerator in accordance with a preferred embodiment of the present invention.

FIG. 1B is a flow chart of a quick refrigerating control method of a refrigerator in accordance with the preferred embodiment of the present invention. In this method, after the user selects the quick refrigerating function in the first step S19, whether both the freezer and the refrigerating compartment's current temperatures $T_F$ and $T_R$, as detected by their respective temperature sensors 5 and 4, are higher than their respective reference temperature $T_{F.O}$ and $T_{R.O}$ is determined (step S20). These reference temperatures are the same as the previously discussed reference temperatures addressed in FIG. 1A.

Also, the circumstances leading to this state are the same as those cited in the aforementioned quick freezing control method.

If, in the second step, both the current freezer and refrigeration compartment temperatures $T_F$ and $T_R$ are higher than their respective reference temperatures $T_{F.O}$ and $T_{R.O}$, it is then determined whether the predetermined time X has elapsed from the time when the quick refrigerating function was requested (third step S21).

If the use time is less than the predetermined time X, the compressor 1 and the refrigerating compartment fan 3 are turned on and the freezer compartment fan 2 is tuned off (fourth step S22).

Next, the current refrigerating compartment temperature $T_R$ is compared with the user-defined refrigerating compartment set temperature $T_{R.S}$ (fifth step S23). Herein, the user-defined refrigerating compartment set temperature $T_{R.S}$ is set at either 'strong mode', 'intermediate mode' or 'weak mode', which span a predetermined temperature range whose maximum is lower than the reference temperature $T_{R.O}$.

When the current refrigerating compartment temperature $T_R$ is higher than the user refrigerating compartment set temperature $T_{R.S}$. The refrigerating compartment is preferentially cooled by the repetition of the steps S21 and S23 until either the current refrigerating compartment $T_R$ drops below the user-defined refrigerating compartment temperature $T_{R.S}$ in the fifth step S23 or the predetermined time X has elapsed in the third step S21. Both events bring about the release of the quick refrigerating function (sixth step S24).

Returning focus to step S20, if either the freezer or refrigerating compartment temperatures $T_F$ and $T_R$ is below its respective reference temperature $T_{F.O}$ and $T_{R.O}$, it is then determined whether a predetermined time X has elapsed from the time when the quick refrigerating function was requested (seventh step S25).

If the predetermined time X has not passed in the seventh step S25, whether the current refrigerating compartment temperature $T_R$ is higher than the quick refrigerating set temperature $T_{R.P}$, which is between −5° C. and 0° C. is then determined (eighth step S26).

If it is, the current freezing compartment temperature $T_F$ is then compared with the user freezing compartment set temperature $T_{F.S}$ (ninth step S27).

If the current freezing compartment temperature $T_F$ is higher than the user-defined freezing compartment temperature $T_{F.S}$ in the ninth step S27, the compressor 1, the freezer compartment fan 2 and the refrigerating compartment fan 3 are each turned on (tenth step S28).

Alternatively, if the current freezer compartment temperature $T_F$ is lower than the user-defined freezer compartment set temperature $T_{F.S}$, the compressor 1 and the refrigerating compartment fan 3 are turned on but the freezer compartment fan 2 is turned off (eleventh step S29).

While looping through the steps S25–S29, either the current freezer compartment temperature $T_R$ dropping below the quick refrigerating set temperature $T_{R.P}$ (step S26), or the predetermined time X having elapsed (step S25) will bring about the release of refrigerating function (sixth step S24).

During this loop, the freezing compartment's fan 2 is independently turned on or off by another routine base on the relationship between its temperature $T_R$ and the user-defined freezer compartment set temperature $T_{F.S}$.

The quick refrigerating control method and the quick freezing control method are based on the same concept with the exceptions of, in the former, the temperature of the freezer compartment $T_F$ being compared with the freezer compartment set temperature $T_{F.S}$ is exchanged for the latter's step S17 in which the temperature of the refrigerating compartment $T_R$ is compared with the refrigerating compartment set temperature $T_{R.S}$, and the former's step S26 in which the refrigerating compartment temperature $T_F$ is compared with the quick refrigerating set temperature $T_{R.P}$ being exchanged for the latter's step S26 in which the freezer compartment temperature $T_F$ is compared with the quick freezing set temperature $T_{FP}$.

As described above, when both compartments are at abnormal temperature states and the user selects a quick cooling function for either compartment, the inventive method for controlling the quick cooling function controls only the selected compartment's temperature, thereby reducing the time needed to quickly cool the selected compartment, and thus reducing a power consumption.

What is claimed is:

1. A method of quick cooling a refrigerator, said refrigerator having a freezer compartment and a refrigerating compartment and having a means for cooling the freezer compartment and a means for cooling the refrigerator compartment, said freezer compartment and said refrigerating compartment each having a predetermined reference temperature indicative of an abnormally high temperature state, said method comprising the following steps:

(a) selecting either said freezer compartment or said refrigerating compartment to be quick cooled;

(b) determining if the freezer compartment temperature and the refrigerating compartment temperatures are both higher than their respective reference temperature; and (c) when the freezer compartment temperature and the refrigerating compartment temperatures are both higher than their respective reference temperatures, activating only the means for cooling associated with the compartment selected to be quick cooled until a first predetermined condition is satisfied.

2. The method according to claim 1, wherein said first predetermined condition comprises a predetermined time lapse after said quick cooling is selected or a temperature of said selected compartment below a predetermined user set temperature.

3. The method according to claim 1, wherein said freezer compartment reference temperature is in the range of −10° C.±5° C., and said refrigerating compartment reference temperature is in the range of 10°C.±5° C.

4. The method according to claim 3, wherein said predetermined user set temperature is in the range of −21° C. to −15° C. when said freezer compartment is selected to be quick cooled in said first step and 0° C. to 6° C. when said refrigerating compartment is selected to be quick cooled in said first step.

5. The method according to claim 1, further comprising when said compartment temperatures are not both higher than their respective reference temperature in step (b), the steps of:

(d) determining if the temperature of said compartment selected to be quick cooled is higher than a predetermined quick set temperature;

(e) determining if the temperature of the compartment not selected to be quick cooled is higher than a predetermined user set temperature; and (f) activating the cooling means associated with each compartment which is determined to have a temperature above said quick set temperature or said user set temperature as long as a second predetermined condition is not satisfied, said quick set temperature for each compartment being lower than said predetermined user set temperature for the same compartment.

6. The method according to claim 5, wherein said second predetermined condition comprises a predetermined time lapse after said quick cooling is selected or a temperature of said selected compartment below said quick set temperature.

* * * * *

UNITED STATES PATENT AND TRADEMARK OFFICE

CERTIFICATE OF CORRECTION

PATENT NO. : 5,787,718

DATED : August 4, 1998

INVENTOR(S) : SEO

It is certified that error appears in the above-indentified patent and that said Letters Patent is hereby corrected as shown below:

Title page, second line of heading, "Jeong" should be "Seo".

Title page, in item [75], the inventor's name should be --Kook Jeong Seo, Seoul, Rep. of Korea--

Signed and Sealed this

First Day of December, 1998

*Attest:*

*Attesting Officer*

Bruce Lehman

BRUCE LEHMAN

*Commissioner of Patents and Trademarks*